US006015145A

United States Patent [19]

Hartel

[11] Patent Number: 6,015,145

[45] Date of Patent: Jan. 18, 2000

[54] SEPARATOR GUIDE FOR Z-FOLDED SHEETS

[76] Inventor: Siegfried Hartel, 210 Normandy Dr., Brunswick, Ohio 44212

[21] Appl. No.: 08/963,204

[22] Filed: Nov. 3, 1997

[51] Int. Cl.[7] ..... B65H 3/26

[52] U.S. Cl. ..... 271/98; 271/100; 271/106; 270/52.2

[58] Field of Search ..... 271/98, 104, 106, 271/100, 11, 101, 107; 270/52.16, 52.19, 52.2, 52.22, 52.29, 52.23

[56] References Cited

U.S. PATENT DOCUMENTS

| | | | |
|---|---|---|---|
| 1,030,891 | 7/1912 | Kast | 270/52.26 |
| 2,159,456 | 5/1939 | Spiess | 271/106 |
| 2,161,866 | 6/1939 | Huckins | 271/104 |
| 2,413,358 | 12/1946 | Kleineberg | 270/52.29 |
| 2,564,417 | 8/1951 | Baker et al. | 271/100 |
| 2,621,039 | 12/1952 | Kleineberg et al. | 270/52.16 |
| 3,100,110 | 8/1963 | Winkler et al. | 271/104 |
| 3,544,097 | 12/1970 | Linden | 271/277 |
| 3,565,422 | 2/1971 | McCain | 271/95 |
| 3,586,316 | 6/1971 | Ehlscheid et al. | 271/98 |
| 3,650,525 | 3/1972 | Hageman et al. | 271/101 |
| 3,768,804 | 10/1973 | Swanson | 271/101 |
| 4,625,952 | 12/1986 | Schniter | 271/82 X |
| 4,637,600 | 1/1987 | Bartimes et al. | 271/106 X |
| 4,768,770 | 9/1988 | Pessina et al. | 271/107 |
| 5,137,267 | 8/1992 | Wirz et al. | 271/98 X |

*Primary Examiner*—Donald P. Walsh
*Assistant Examiner*—Patrick Mackey
*Attorney, Agent, or Firm*—James A. Lucas; Driggs, Lucas, Brubaker & Hogg Co., L.P.A.

[57] ABSTRACT

A saddle stitching machine is modified by attaching a device which permits the machine to process outside Z-folded sheets when collating a plurality of sheets together for a magazine or other publication. The device operates in synchronization with a suction take-offs and gripper disc of a pocket to permit the sheets to be removed from a stack and deposited on a saddle without jamming. The device utilizes one or more oscillating fingers operating off a cam journaled to the shaft of the gripper disc, and air jets to facilitate transport of each sheet through the stitcher for deposit on the saddle.

14 Claims, 4 Drawing Sheets

SEPARATOR GUIDE FOR Z-FOLDED SHEETS

FIELD OF THE INVENTION

This invention relates generally to machines which are used to assemble pages for magazines, catalogs, or brochures, etc. More specifically, this invention relates to saddle stitchers which rapidly and effectively assemble individual pages, and staple or otherwise bind the pages together into magazines or the like.

BACKGROUND OF THE INVENTION

Saddle stitchers are complex machines which are composed of a plurality of individual units called pockets. These machines are produced by a number of different manufacturers such as Consolidated International Corporation in Chicago, Ill. These machines are capable of gathering and stitching anywhere from 1,000 to as many as 20,000 sheets per hour.

In recent years, artistic designers and advertisers have desired to include Z folded sheets into magazines and advertising literature. Although the incorporation of inside folded sheets into magazines does not create a serious problem in saddle stitching machines, the use of outside Z folded sheets does pose a problem. The problem relates to the inability of existing machines to feed the individual sheets through the machine without a loose edge of the sheet causing jamming of the pocket of the machine, thereby necessitating a shutdown of the entire assembly line while the pocket in which the jamming occurred is unjammed. This problem is presently addressed by feeding the sheet through the stitcher as an inside Z fold, and thereafter manually refolding the sheet to an outside fold. Obviously, this adds an expensive and time consuming manual step to the overall assembly process. Thus, there remains a serious need for remedying this problem.

BRIEF DESCRIPTION OF THE INVENTION

It is an objective of the present invention to overcome the objections and drawbacks of incorporating outside Z folded sheets into a magazine or other publication.

Another objective of the present invention is providing a simple device which can be quickly and simply added to a pocket of a saddle stitcher to permit the insertion of an outside Z folded sheet into a publication being assembled on the machine.

It is yet another objective of the present invention to reduce the amount of manual labor and associated costs in the assembly of outside Z-folded pages on a saddle stitcher.

These and other objectives are accomplished in accordance with the present invention by the use of a device on a single pocket of a saddle stitcher for facilitating the transfer of an outside folded sheet to the saddle of the saddle stitcher. The saddle stitcher includes a frame, a stacking tray, suction take-offs to remove individual sheets of paper one at a time from the stacking tray, a cylindrical gripper disc mounted on a rotating shaft, gripper means on the gripper disk for clamping the leading edge of a sheet of paper, and a saddle shuttle.

The Z folded sheet comprises first and second flaps joined at a first fold and second and third flaps joined at a second fold whereby a free edge of the third flap terminates in close proximity, but short of the first fold. The Z-folded sheet is placed on a stacking tray with the first fold forming the leading edge of the sheet as the sheet is withdrawn from the stacking tray and is transferred to the saddle shuttle. The device for facilitating transfer of the Z-folded sheet comprises a cam, mountable on a shaft on one side of the gripper disc, a cam follower operatively engaging the cam, means for translating the motion of the cam follower into reciprocating linear motion, at least one sheet guide connected to the translating motion means movable linearly toward the gripper disc after the first flap of the Z-folded sheet is removed from the stacking tray by the suction take-offs, and pneumatic means to deflect the free edge of the third flap into contact with the guide to cause the flap to be biased toward and clamped by the gripping means along with the first fold of the sheet.

The sheet guide comprises at least one and preferably a plurality of fingers, each finger including a diagonal sheet guiding surface. The pneumatic means includes an air jet associated with each finger, the air jet comprising an air tube with an air outlet terminating near the end of the associated finger, and preferably at least one additional air jet in proximity to the free edge of the third flap remote from each finger.

The invention also comprises a saddle stitcher for assembling an outside Z-folded sheet into a magazine or the like wherein the Z-folded sheet comprises first and second flaps joined at a first fold and second and third flaps joined at a second fold and wherein a free edge of the third flap terminates in close proximity to the first fold. The saddle stitcher comprises a stacking tray, means comprising one or more suction cups for removing one Z-folded sheet at a time from the stack of sheets on the stacking tray to deliver the sheet to the saddle, and a rotating gripper disc.

The suction cups are mounted to pivot into contact with one sheet as the gripper disc revolves and to pivot away from the stack to draw the one sheet from the stack toward the disc. The improvement comprises means to facilitate feeding of the Z-folded sheet from the tray to the gripper disc in cooperation with the suction cups. This facilitating means includes at least one guide surface to direct the free edge of the third flap of the sheet from the tray onto the gripper disc and at least one jet of pressurized air to deflect the free edge away from the stack of sheets on the stacking tray and into contact with the guide surface.

The guide comprises at least one guide finger which is positioned in proximity with the stack of Z-folded sheets in the stacking tray as the suction cup pivots into contact with the sheet. A jet of pressurized air is associated with each guide finger and serves to deflect the free edge of the third flap into contact with a diagonal surface of the guide finger.

The present invention also comprises a method of removing an outside Z-folded sheet from a stack of Z-folded sheets and restacking the sheet on a saddle stitcher, wherein each Z-folded sheet comprises first and second flaps joined at a first fold and second and third flaps joined at a second fold and wherein a free edge of the third flap terminates in close proximity to the first fold. The sheet is placed in a stack with the first fold forming the leading edge of the sheet. The method comprises applying suction to the first flap near the first fold and drawing the flap into contact with a gripper which pulls the sheet around a gripper disc to additional means which opens the first fold and deposits the sheet onto the saddle of the saddle stitcher.

The improvement comprises deflecting the first free edge of the third flap away from the stack and toward the gripper to permit the gripper to simultaneously grip the first fold and the free edge of the third flap as the sheet is moved around the gripper disc.

The method includes deflecting the free edge of the third flap by pressurized air to bias the free edge toward the grippers by a plurality of guide fingers. The pressurized air is delivered through a plurality of air tubes, with one air tube associated with and having an outlet in proximity to the end of each finger. Additional air tubes terminate near the free edge of the third flap and cooperate with the other air tubes to deflect the free edge of the flap to enable the flap to be contacted by the fingers to guide them toward the grippers.

DETAILED DESCRIPTION OF THE INVENTION

Figure 1:
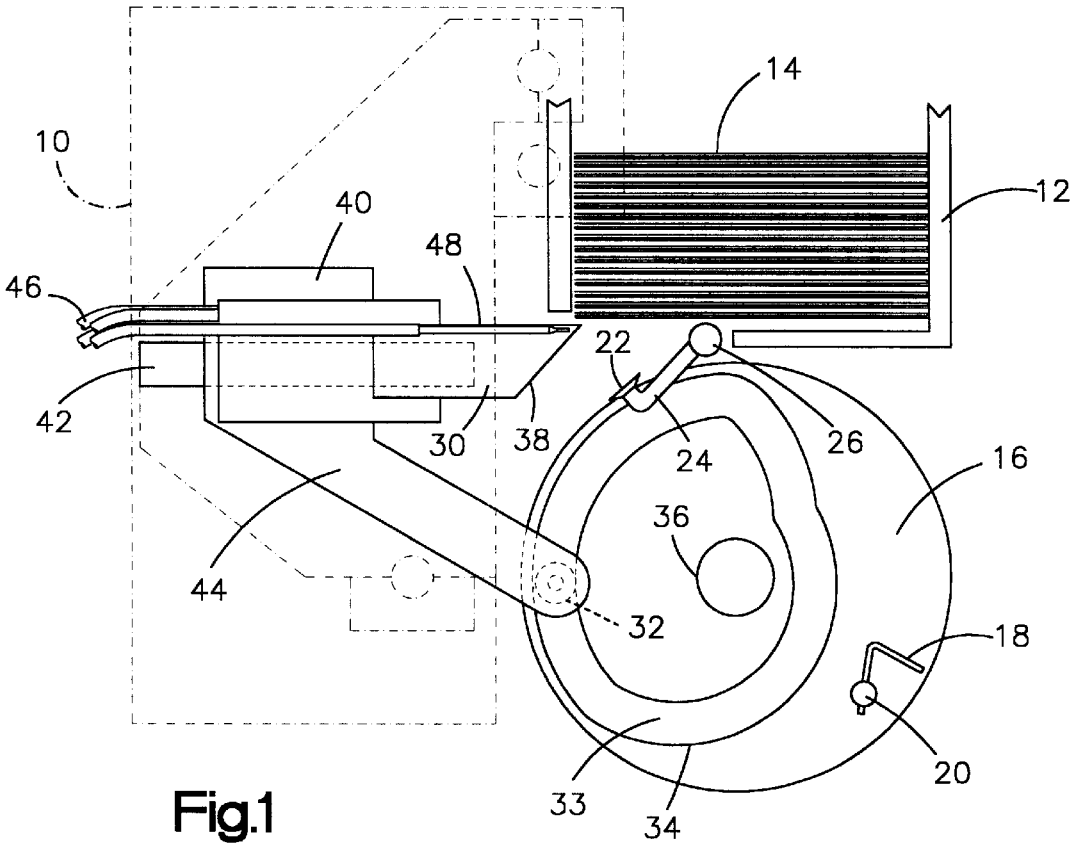
FIG. 1 is an elevational view of a portion of the feeder pocket with the device of the present invention mounted thereon.

Referring now to the drawings, FIG. 1 shows the device of the present invention. including in outline, the structural frame 10 of a single pocket of a saddle stitcher. Included with the saddle stitcher is a stacking tray 12 and a plurality of sheets 14 stacked thereon. In close proximity to the stacking tray 12 is a rotating gripper disc 16 having one or more grippers 18 mounted thereto by a pivot 20. One or more suction cups 22 are coupled by connecting arms 24 to pivot rod 26.

Figure 4:
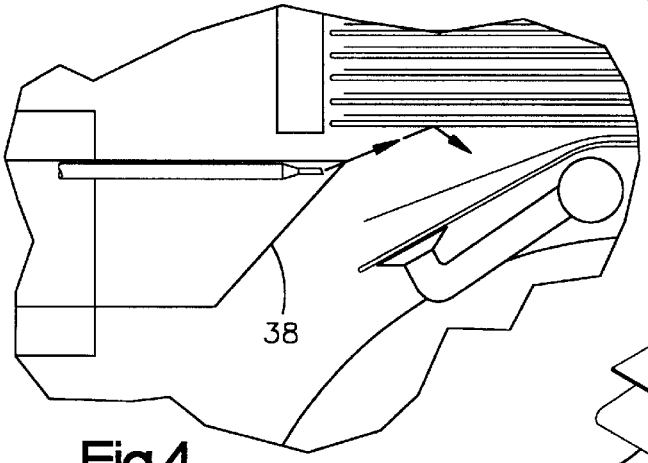
FIG. 4 is an enlarged view of a finger and an associated air jet.

The device of the present invention comprises one or more guide fingers 30 linearly movable in an oscillating pattern in response to a cam follower 32 tracking the groove 33 of cam 34 secured to shaft 36 on which the gripper disc 16 is mounted. The fingers include a diagonal guide surface 38. The fingers are joined to a block 40 slidably mounted on rod 42. The slide block is joined by arm 44 to the cam follower 32. A plurality of air lines 46 supply low pressure air to finger jets 48 and outboard jets shown in FIG. 4.

Referring now to FIGS. 2A–2E, the sequence of operation of the device of the present invention is shown in greater detail.

Figure 5:
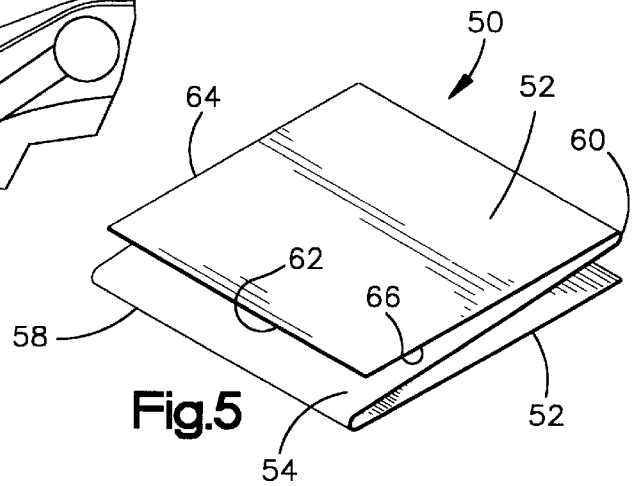
FIG. 5 is a perspective view of an outside Z-folded sheet.

As the gripper disc 16 rotates counterclockwise about the shaft 36, the suction cups 22 pivot into contact with the bottom sheet of a stack of Z-folded sheets. One such sheet 50 is shown slightly open for clarity in FIG. 5 and is comprised of first flap 52, second flap 54 and third flap 56. The first and second flaps are joined by first fold 58 and the second and third flaps are joined by second fold 60. The third flap terminates along free edge 62. As shown, the third flap is slightly narrower (about ¼" to ½") than the first and second flaps.

The third flap 56 is joined to the second fold 60 by top and bottom edges 64 and 66 respectively.

Figure 2A:
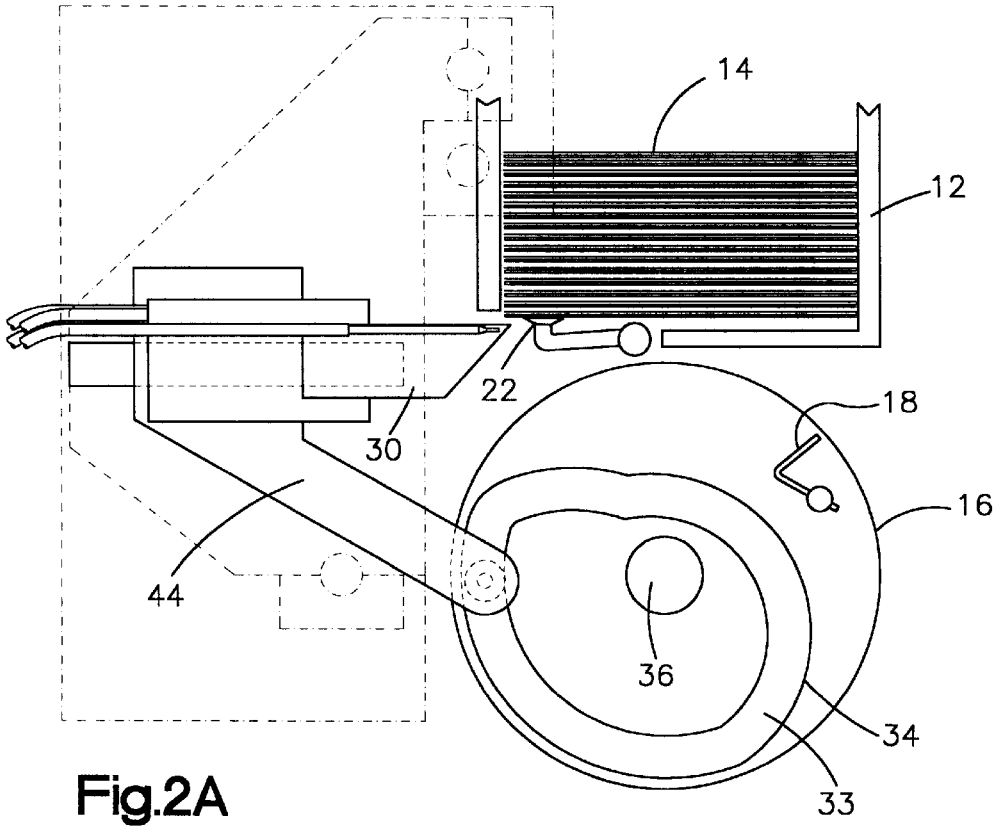
FIGS. 2A through 2E are side views showing the sequential steps of removing a Z-folded sheet from a stack and then transferring the sheet to a gripper drum.
Figure 2B:
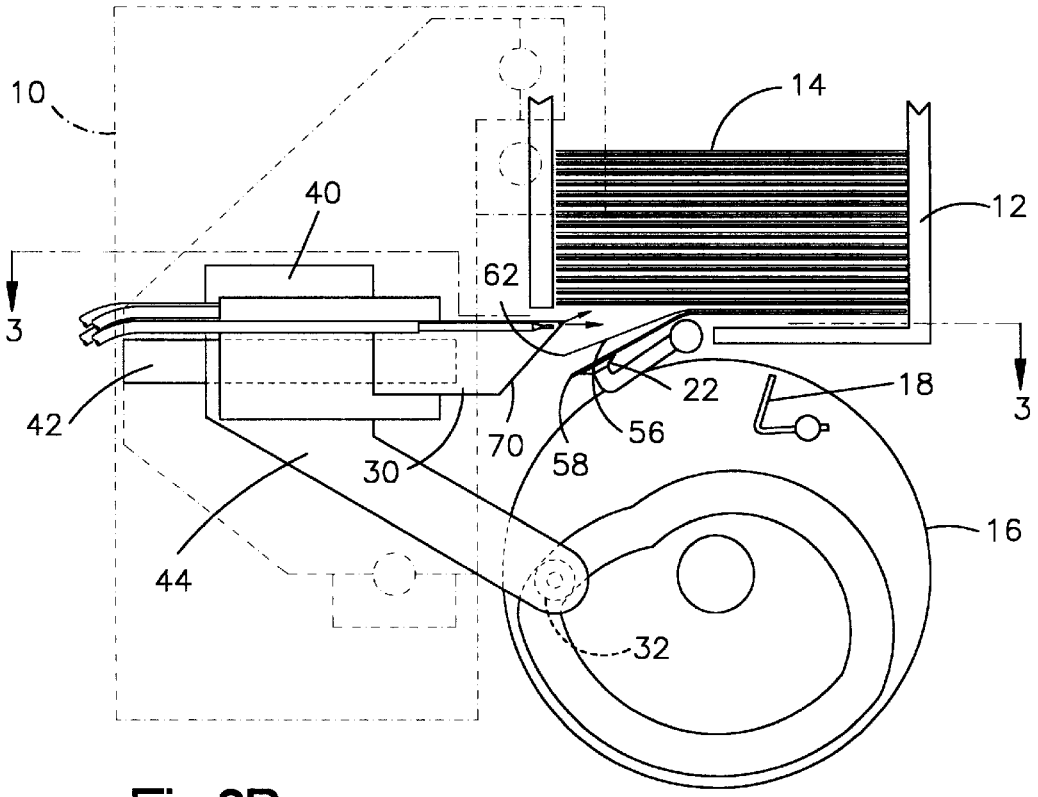

At this position of the suction cups, as shown in FIG. 2A, the pathway of the cam 34 shuttles the fingers 30 away from the suction cups so as not to interfere with the cups pulling the flap and the fold of the bottom sheet. The tips of the fingers extend about 1/32" inside the edge of the stack of Z-folded sheets to support the same. As shown in FIG. 2B, the suction cups 22 swing the first two flaps and first fold 58 of the bottom sheet 50 toward the gripper disc 16 as the cam follower 32, continuing to trace the pathway of the cam, moves the fingers toward the disc 16. At the same time, one or more, and preferably two finger jets 48 and two outboard jets deflect the free edge 62 of the third flap downward so that the free edge slides along the guide surface 38 of the finger 30.

Figure 2C:
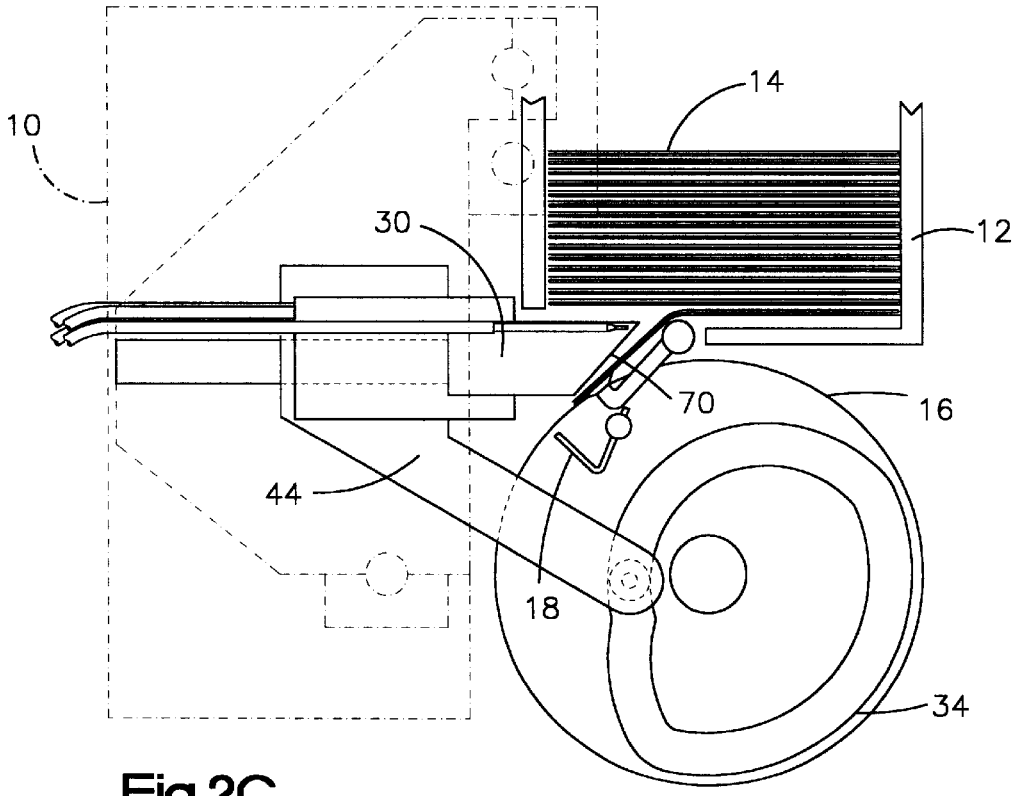
Figure 2D:
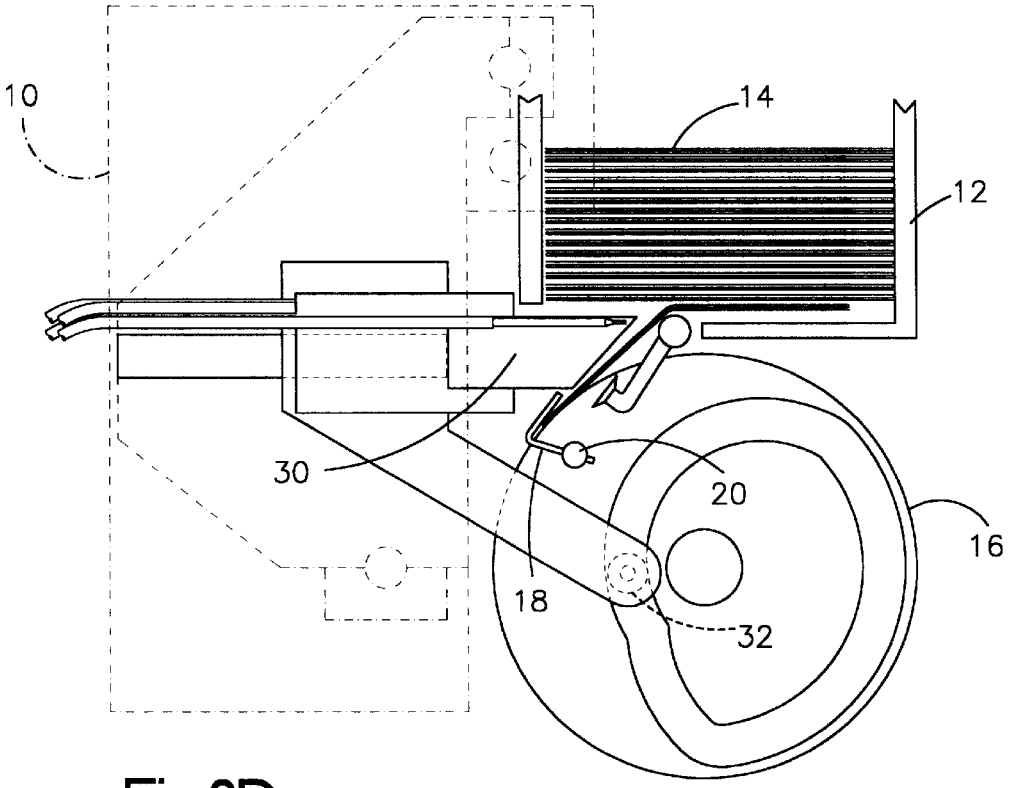
Figure 2E:
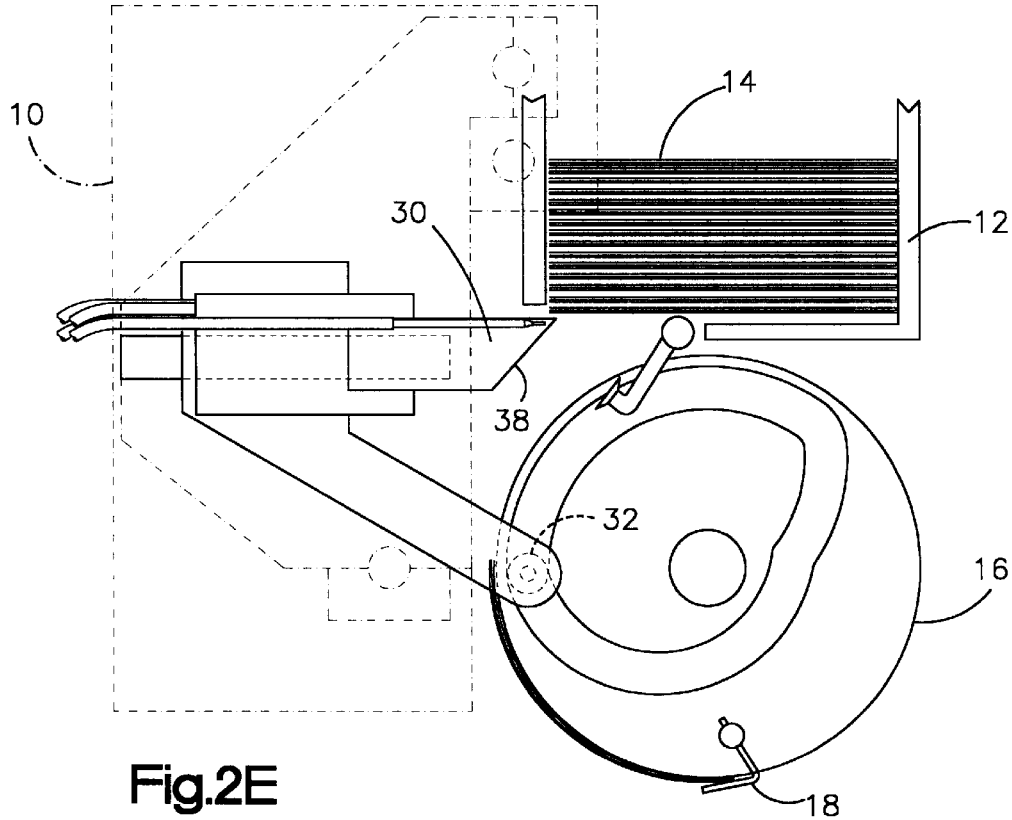

As the disc continues to rotate to the position shown in FIG. 2C, the fingers 30 are fully extended beneath the stack of Z-folded sheets. The third flap of the sheet is guided along guide surface 38 of the fingers 30. Then, as shown in FIG. 2D, the gripper 18 swings around pivot 20 to clamp the first fold and the free edge of the third flap against the rotating gripper disc 16. As the disc 16 continues to rotate, the cam follower 32 moves the fingers from beneath the stack to the fully retracted position shown in FIG. 2E while the gripper holds the Z-folded sheet.

The sheet is then handled in subsequent steps in the normal operation of the saddle stitcher, the steps of which are all well known and which form no part of the present invention. Typically, in these subsequent steps, the first fold of the sheet is unfolded and the sheet is deposited on a saddle which moves laterally on a shuttle beneath each pocket of the saddle stitcher, with each pocket adding another sheet as the pages of the publication are collated and then stapled or bound together.

Figure 3:
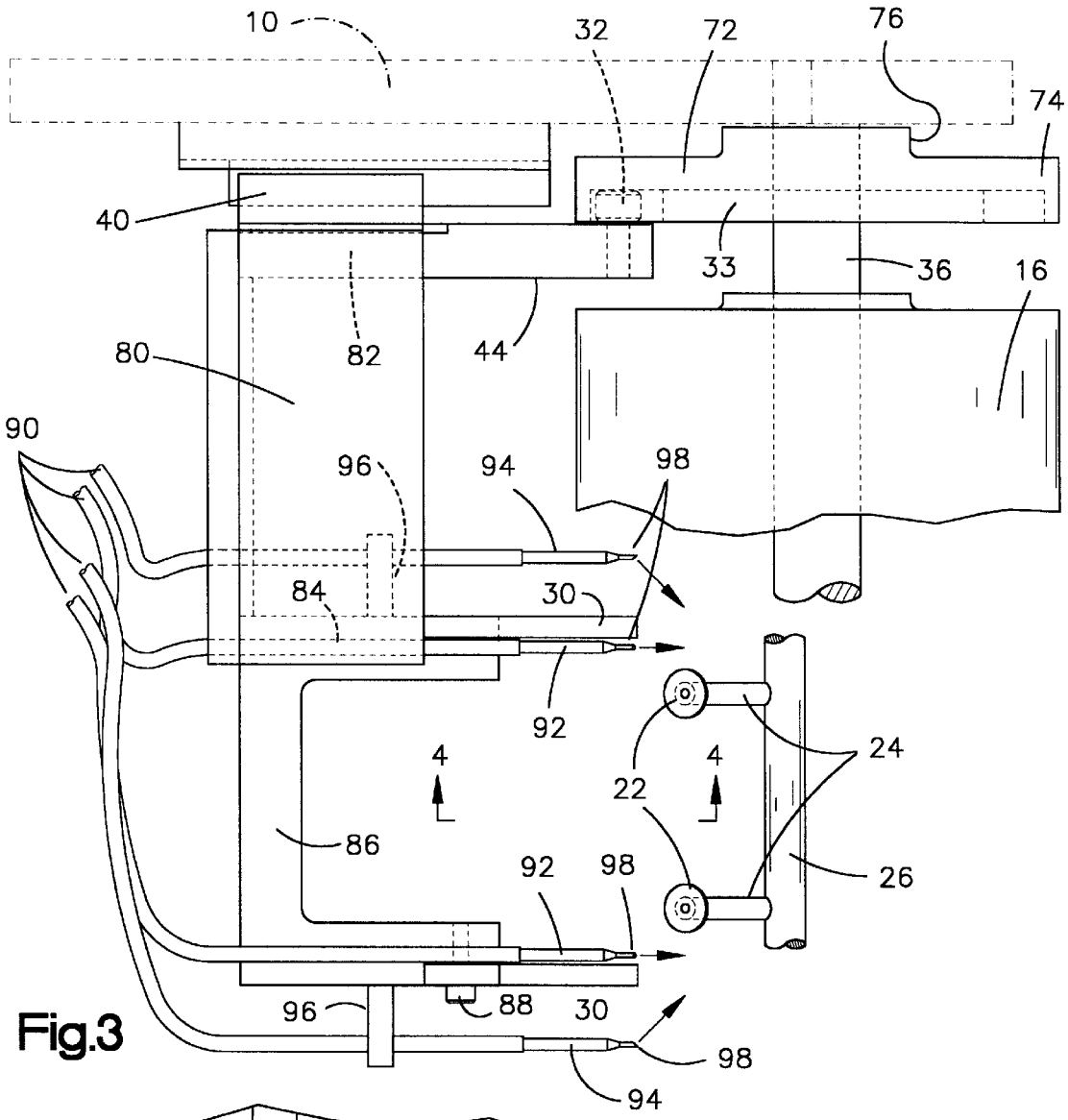
FIG. 3 is a plan view of the device of the present invention installed on the pocket of a saddle stitcher.

Referring now to FIG. 3, the device of the present invention is shown removably mounted to the frame 10 of a pocket of a saddle stitcher. The cam preferably is produced in two halves, 72, and 74 each including one half of a flange 76, for ease of assembly onto the shaft 36 of an existing feeder. The flange halves are joined together by suitable means such as threaded connections, e.g. machine screws, or nuts and bolts, passing through aligned holes in the two parts of the flange offset from the shaft. This construction of the cam permits ready adjustment, to advance or to retard the movement of the fingers relative to the rotation of the gripper disc and the operation of the suction cups This also permits the quick removal and transfer of the device from one pocket to another. Alternatively, if the device of the invention is to be included as part of the original equipment, a one piece cam can be used being secured to the main shaft by use of a set screw, key slot or the like.

The frame 10 includes shaft 36 on which the gripper disc 16 is mounted. The pocket includes a pair of suction cups 22 secured to rod 26 by connecting arms 24. The cam follower 32 is joined to cam arm 44 which engages slide block 40. First end 82 of connecting plate 80 is mounted on the slide block 40 and second end 84 is joined to a U-shaped bracket 86 to which the fingers 30 are secured by suitable means such as bolts 88.

A plurality of air lines 46 feed low pressure air to finger jets 48, which terminate near the tip of the fingers, and to outboard jets 94. The finger jets are clipped to or are otherwise mounted close to the fingers. Alternatively, small bores can be drilled in the fingers, terminating near the guide surface thereof, with a suitable air connection being made to the air supply. The finger jets serve to deflect the free edge of the Z-fold sheet toward the suction cups 22. The outboard jets are secured to the U-shaped bracket 86 by suitable means such as brackets 96. The tips 98 of the jets preferably are cut at a bias to ensure that the air flow is directed in such a manner as to properly deflect the free edge of the sheet.

The cam follower 32 engages and tracks the groove 33 in the radial face of the cam. Instead of a slot in the face, the peripheral surface of the cam can be machined to the necessary contour with the cam follower bearing against the peripheral surface rather than in the slot.

The cam follower 32 comprises a hardened steel ball bearing roller cam. The cam 34 is journaled to the cam arm 38 which in turn is joined to a suitable reciprocating mechanism which converts the circular motion of the saddle stitcher shaft into linear motion. For this purpose, a linear motion ball slide has been found to be suitable. Preferably the ball slide is load bearing and self-cleaning. The Model 24-3C ball slide marketed by Ball Slides, Inc. in Medford, Mass., is one example of a slide which has been found to be satisfactory for this purpose.

The ball slide is joined by a connecting plate to a pair of fingers which alternately move through the linear motion, into proximity with the gripper disc, and away therefrom as the disc rotates about the drive shaft. Inasmuch as the cam and the disc are joined to the same shaft, one revolution of the disc corresponds to one revolution of the cam, thereby causing the fingers to move through one complete cycle during each revolution of the disc. When the fingers 30 are fully retracted, the fingers are positioned so that the tips extend about 1/32" beneath the outer edge of the stack, thereby supporting the stack. This allows the suction cups to pull the first fold of the bottom sheet down toward the gripper disc. When the suction cups have pulled the first fold through an angle of about 10 degrees, the fingers begin to move linearly toward the disk, thus pushing the free edge of the top flap along the guide surface 38 down against the bottom fold.

In a preferred teaching of the invention, the diagonal guide surface of the fingers forms an angle of approximately 48 degrees with respect to the axis of the fingers. The air under pressure is delivered through air lines having an inner diameter of about 100 mils. The ends of the jets associated with the fingers are cut at an angle of about 30 degrees, and are positioned so that the air blows against the bottom of the stack of sheets in the paper tray. As noted in FIG. 4, the air is bounced off of the bottom of the stack against the free edge 60 causing the edge to be deflected along the guide surface 38 of finger 30 in the direction of the suction cups 22.

Various modifications can be made in the invention without departing from the functional aspects of the same. For example, the precise location and the number of fingers can be changed; the shape of the diagonal guide can be arcuate rather than straight; and the number and location of the air jets which are used to deflect the free flap of the page can be altered without defeating their basic purpose. Furthermore, the air nozzles can be arranged to direct the air jets directly against the free flap rather than against the bottom of the stack, to deflect the free flap against the finger guide into engagement with the grippers.

Although the apparatus has been shown and described in connection with the gripper disc equipped with one gripper, the diameter of the disc can be large enough to accommodate two or more grippers at evenly spaced intervals around the circumference of the disc. With the use of multiple grippers, the cam pathway provides for the guide fingers to reciprocate toward and away from the stack as each gripper passes the stacking tray. In other words, if the gripper disc includes two sets of grippers, the fingers oscillate toward and away from the gripper disc twice during each revolution of the disc. Because of the speed of multiple grippers, suitable electronic solenoids can be used in place of the mechanical action of the cam to oscillate the fingers toward and away from the gripper disc.

Other modifications can be made in the teachings of the present invention without departing from the scope thereof. For example, the operation of the shuttle for the guide fingers can be controlled electronically or by suitable electropneumatic means rather than by employing a mechanical linkage for the cam and cam follower.

The device of this invention is preferably fabricated from a suitable structural material which will withstand the speed and the vibration associated with a high-speed saddle stitcher. Typically, the structural and working components such as the cam, cam follower, connecting plate, U-bracket and fingers are machined from steel. The air lines and jets can be made of plastic, rubber or aluminum.

The invention can be used equally well with a saddle stitcher equipped with vertical feeds or horizontal feeds While the invention has been described in combination with embodiments thereof, it is evident that many alternatives, modifications and variations will be apparent to those skilled in the art in light of the foregoing teachings. Accordingly, the invention is intended to embrace all such alternatives, modifications and variations as fall within the spirit and scope of the appended claims.

What is claimed is:

1. For use with a single pocket of a saddle stitcher including a frame, a stacking tray, suction take-off means to remove sheets of paper, one at a time from the stacking tray, a cylindrical gripper disc mounted on a rotating shaft, gripper means on the gripper disc for clamping the leading edge of a sheet of paper, and a saddle shuttle, a separator guide for an outside Z folded sheet, said sheet comprising first and second flaps joined at a first fold and second and third flaps joined at a second fold, wherein the free edge of the third flap terminates in close proximity to, but short of the first fold, the Z-folded sheet placed on the stacking tray with the first fold forming the leading edge of the sheet as the sheet is withdrawn from the stacking tray and is transferred to the saddle shuttle, said device comprising:

a) a cam mounted on the shaft on one side of the gripper disc;

b) a cam follower operatively engaging the cam;

c) means for translating the motion of the cam follower into reciprocating linear motion;

d) at least one sheet guide connected to the translating motion means movable linearly toward the gripper disc after a first flap of the Z-folded sheet is removed from the stacking tray by the suction take-offs; and e) pneumatic means to deflect the edge of the third flap into contact with the guide to cause the flap to be biased toward, and clamped by the gripping means along with the first fold of the sheet.

2. The transfer facilitating device according to claim 1 wherein the at least one sheet guide comprises a plurality of fingers, each finger including a sheet guide surface, and the pneumatic means includes an air jet comprising an air tube with an air outlet terminating near the end of each finger and moveable linearly with each finger toward and away from the stacking tray.

3. The transfer facilitating device according to claim 2 wherein the pneumatic means includes at least one additional air jet in proximity to the free edge of the third flap.

4. A saddle stitcher including a separator guide for assembling an outside Z folded sheet into a magazine or the like wherein the Z-folded sheet comprises first and second flaps joined at a first fold and second and third flaps joined at a second fold, and wherein a free edge of the third flap terminates in close proximity to the first fold, the saddle stitcher comprising a stacking tray and means to remove one Z folded sheet at a time from a stack of sheets on the stacking tray and to deliver the sheet to a saddle, said separator guide including:

a) a rotating gripper disc, b) a plurality of suction cups in proximity to the stack, said suction cups mounted to pivot into contact with one sheet of the stack as the gripper disc revolves, and to pivot away from the stack to draw the one sheet from the stack toward the disc, and gripper means rotating with the disc to receive the sheet and to draw the sheet around the disc, the improvement comprising means to facilitate feeding of the Z folded sheet from the tray to the gripper disc in cooperation with the suction cups, said means including at least one guide surface to direct the free edge of the third flap of the sheet from the tray onto the gripper disc and at least one jet of pressurized air applied to the sheet to deflect the free edge away from the stack of sheets on the stacking tray into contact with the guide surface.

5. The saddle stitcher according to claim 4 wherein the at least one guide surface comprises a guide finger which is positioned adjacent to the stack of Z folded sheets in the stacking tray as the suction cups pivot into contact with said one sheet.

6. The saddle stitcher according to claim 5 wherein a jet of pressurized air serves to deflect the free edge of the third flap into contact with each guide finger.

7. The saddle stitcher according to claim 5 wherein the gripper disc is mounted on a rotating shaft and the means for removing the two folded sheet from the stack includes a cam mounted on the shaft on one side of the gripper disc, a cam follower operatively engaging the cam, and further means for translating the motion of the cam follower into reciprocating linear motion, coupled to the guide finger to move the guide finger alternately toward and away from gripper disc.

8. A method of removing an outside Z-folded sheet from a stack of Z-folded sheets and restacking the sheet on a saddle stitcher, wherein the Z-folded sheet comprises first and second flaps joined at a first fold and second and third flaps joined at a second fold, and wherein a free edge of the third flap terminates in proximity to the first fold, the sheet placed in a stack with the first fold forming the leading edge of the sheet, the method comprising applying suction to the first flap near the first fold and drawing the flap into contact with grippers which pull the sheet around a gripper disc to additional suction means which open the first fold and deposit the sheet on the saddle, the improvement comprising deflecting the first free edge of the third flap away from the stack and toward the grippers to permit the grippers to simultaneously grip the first fold and the free edge as the sheet is moved around the gripper disc.

9. The method according to claim 8 wherein the free edge of the third flap is deflected toward the grippers by pressurized air.

10. The method according to claim 8 wherein the free edge of the third flap is biased toward the grippers by a plurality of fingers.

11. The method according to claim 8 wherein the free edge of the third flap is deflected toward the grippers by the combined effect of a plurality of fingers and pressurized air.

12. The method according to claim 11 wherein the pressurized air is delivered through a plurality of air tubes.

13. The method according to claim 12 wherein each finger includes one air tube with an outlet in proximity to the end of the finger.

14. The method according to claim 13 further including additional air tubes having outlets near the free edge of the third flap and cooperating with the tubes of each finger to deflect the free edge of the flap to enable the flap to be contacted by the fingers to bias them toward the grippers.

* * * * *